United States Patent [19]

Wakamiya et al.

[11] Patent Number: 4,709,570

[45] Date of Patent: Dec. 1, 1987

[54] METHOD FOR SETTING STEEL STOCK DISCHARGE TEMPERATURE OF HEATING FURNACE IN HOT ROLLING LINE

[75] Inventors: Yoshinori Wakamiya; Tomoko Sumino, both of Hyogo, Japan

[73] Assignee: Mitsubishi Denki Kabushiki Kaisha, Tokyo, Japan

[21] Appl. No.: 795,326

[22] Filed: Nov. 6, 1985

[30] Foreign Application Priority Data

Nov. 7, 1984 [JP] Japan ..... 59-236429

[51] Int. Cl.[4] ..... B21B 1/22; B21B 37/10

[52] U.S. Cl. ..... 72/365; 72/13; 72/202; 364/472

[58] Field of Search ..... 72/13, 200, 202, 8, 72/365, 366, 19; 364/472

[56] References Cited

U.S. PATENT DOCUMENTS

| | | | |
|---|---|---|---|
| 3,695,594 | 10/1972 | Hollander | 72/13 X |
| 4,373,364 | 2/1983 | Tanimoto et al. | 72/13 X |
| 4,589,268 | 5/1986 | Sakurada et al. | 72/13 X |
| 4,598,377 | 7/1986 | Takagi et al. | 72/202 X |
| 4,606,006 | 8/1986 | Kitao et al. | 72/8 X |

FOREIGN PATENT DOCUMENTS

| | | | |
|---|---|---|---|
| 133408 | 10/1979 | Japan . | |
| 0022417 | 2/1980 | Japan | 72/13 |
| 0058905 | 4/1983 | Japan | 72/13 |

*Primary Examiner*—Robert L. Spruill
*Assistant Examiner*—Steve Katz
*Attorney, Agent, or Firm*—Bernard, Rothwell & Brown

[57] ABSTRACT

A method for setting a steel stock discharge temperature of a heating furnace in a hot rolling line in which both fuel unit consumption in the heating furnace and that in a rolling line are calculated to obtain a total fuel unit consumption in the entire line, and an optimum discharge temperature is calculated so as to satisfy a metallurgical discharge temperature restrictive condition and minimize the above total fuel unit consumption and the optimum discharge temperature is used as the steel stock discharge temperature.

1 Claim, 5 Drawing Figures

FIG. 1
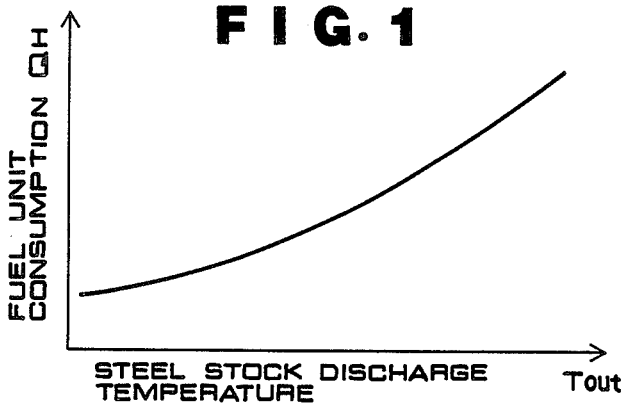
FIG. 2
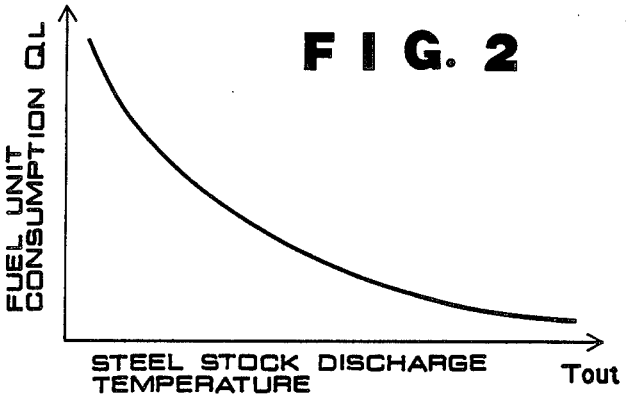
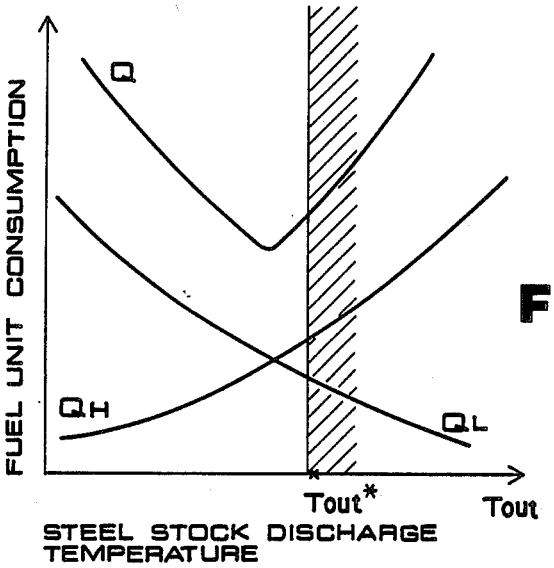
FIG. 3

METHOD FOR SETTING STEEL STOCK DISCHARGE TEMPERATURE OF HEATING FURNACE IN HOT ROLLING LINE

BACKGROUND OF THE INVENTION

1. Field of the Invention

The present invention relates to a method for setting a steel stock discharge temperature of a heating furnace in a hot rolling line. Particularly, it is concerned with a steel stock discharge temperature setting method capable of attaining energy saving throughout the entirety of a hot rolling line including a heating furnace portion and a rolling portion.

2. Description of the Prior Art

Heretofore, in connection with the energy saving of a rolling line, reference has not been made to determining a steel stock discharge temperature itself, and it has been considered that a host computer is given such steel stock discharge temperature.

For example, as described in Japanese Patent Laid-Open Publication No. 133408/79, there is performed setting of a furnace temperature pattern for minimizing, in a heating furnace alone, the energy consumed in the heating furnace. And the steel stock discharge temperature is determined as follows. A metallurgically defined discharge temperature $T_{out}$* and a discharge temperature $T_{out}$** to ensure the temperature at each point of a rolling line are tabulated experientially and the larger one is defined as the discharge temperature.

Generally, the discharge temperature $T_{out}$** defined from the rolling line is higher than the metallurgically defined discharge temperature $T_{out}$*. Actually, however, the discharge temperature $T_{out}$** defined from the rolling line is determined experientially with a considerable margin, so there is a considerable waste from the standpoint of energy saving.

On the other hand, with respect to a rolling line, the discharge temperature is considered to be predetermined, and by a schedule calculation there are determined a plate thickness pattern and a speed pattern at each stand so as to satisfy restrictive conditions of the stand. Thus, the energy saving is not considered.

According to the conventional energy saving method in a rolling line, the energy in a heating furnace is minimized, assuming that the steel stock discharge temperature is predetermined. Thus, no consideration is given to the saving of energy throughout the entire line and consequently there is the drawback that energy is consumed wastefully.

SUMMARY OF THE INVENTION

The present invention has been accomplished in order to overcome the above conventional drawback, and it is an object thereof to provide a method for setting a steel stock discharge temperature of a heating furnace in a hot rolling line which method pursues a discharge temperature in a heating furnace control, considering the relation to a rolling line, and which can attain the saving of energy throughout the entire line including a heating furnace portion and a rolling portion.

Other objects and advantages of the present invention will become more apparent from the following detailed description of an embodiment taken in connection with the accompanying drawings.

BRIEF DESCRIPTION OF THE DRAWINGS

FIG. 1 is a graph showing a relation between a steel stock discharge temperature and fuel unit consumption in a heating furnace, for explanation of a principle of the present invention;

FIG. 2 is a graph showing a relation between a steel stock discharge temperature and fuel unit consumption in a rolling line;

FIG. 3 is a graph showing a relation between a total fuel unit consumption of both fuel unit consumptions shown in FIGS. 1 and 2 and restrictive conditions;

DETAILED DESCRIPTION OF THE PREFERRED EMBODIMENTS

Figure 4:
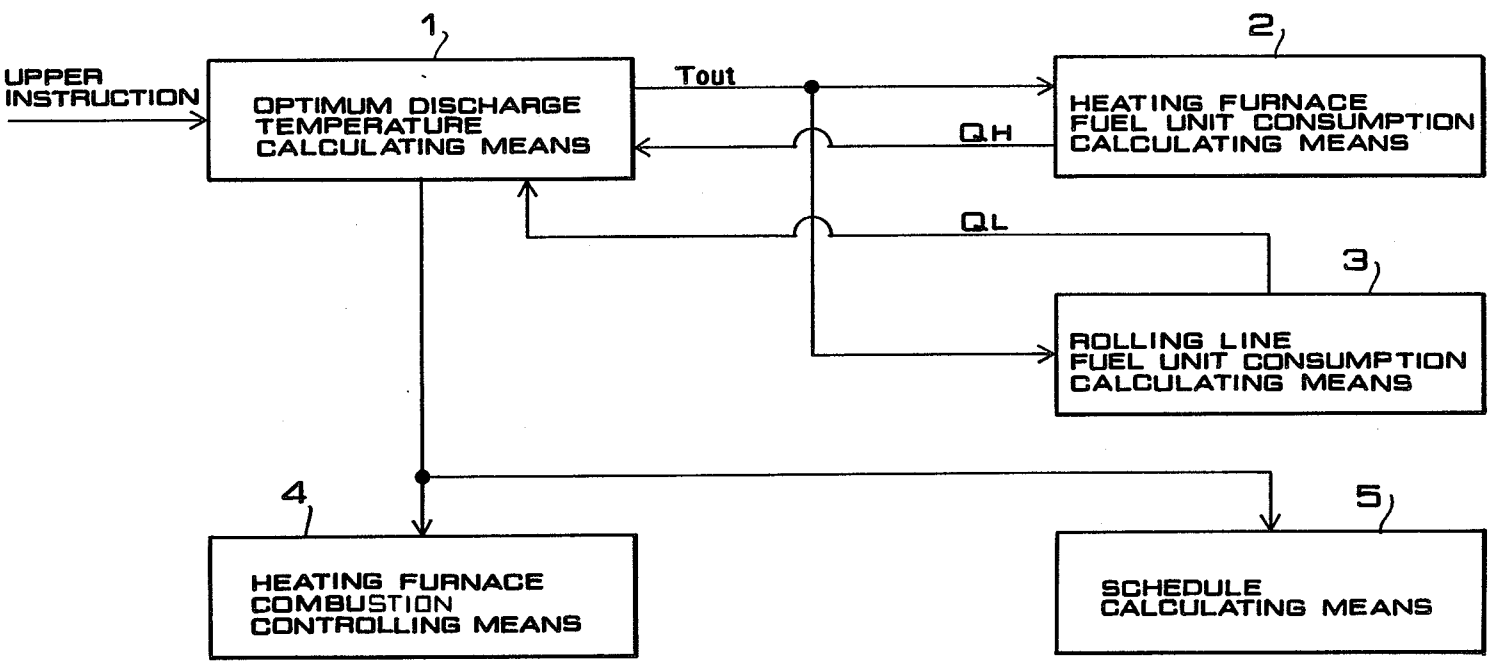
FIG. 4 is a block diagram for explaining a method for setting a steel stock discharge temperature according to an embodiment of the present invention.

An embodiment of the present invention will be described in detail hereinunder with reference to the accompanying drawings.

Referring first to FIGS. 1 to 3, there are shown graphs for explaining a principle of the present invention. Fuel unit consumption $Q_H$ in a heating furnace can be expressed by the following relationship by taking a heat balance of a temperature prediction in each of various positions of a steel stock in the heating furnace and an atmosphere temperature in each of various positions in the furnace and the flow rate of fuel charged:

$$Q_H = f(H, T_{in}, T_{out}, T_G, \Delta t) \quad (1)$$

where,

H: plate thickness in the heating furnace (mm)

$T_{in}$: charging temperature (° C.)

$T_{out}$: discharge temperature (° C.)

$T_G$: intra-furnace atmosphere temperature (° C.)

$\Delta t$: intra-furnace residence time (hour)

Optimization of the heating furnace is to calculate an intra-furnace atmosphere temperature $T_G$ to minimize the fuel unit consumption $Q_H$. Assuming that there is performed optimization of the heating furnace, the fuel unit consumption $Q_H$ in an optimized heating furnace can be calculated by giving a discharge temperature $T_{out}$. FIG. 1 shows a relation between the discharge temperature $T_{out}$ and the fuel unit consumption $Q_H$ in the heating furnace. Reference to FIG. 1 clearly shows that as the discharge temperature $T_{out}$ lowers, the fuel unit consumption $Q_H$ in the heating furnace decreases to a large extent.

On the other hand, as to a fuel unit consumption $Q_L$ in a rolling line, since plate thickness pattern and speed pattern are determined by a schedule calculation (power, rolling force and speed at each stand) and electric energy at each stand is thereby calculated, the fuel unit consumption $Q_L$ is expressed by the following relationship:

$$Q_L = g(H, T_{out}, h, T_D) \quad (2)$$

where, h: final plate thickness (mm)

$T_D$: finishing discharge temperature (° C.)

FIG. 2 shows a relation between the discharge temperature $T_{out}$ and the fuel unit consumption $Q_L$ in the rolling line. Reference to FIG. 2 clearly shows that the fuel unit consumption $Q_L$ in the rolling line decreases as the discharge temperature rises, and thus it is in a relation reverse to the fuel unit consumption $Q_H$ in the heating furnace.

What is intended by the present invention is to determine the discharge temperature so as to minimize a total sum Q of the fuel unit consumption $Q_H$ in the heating furnace and that $Q_L$ in the rolling line.

The discharge temperature is determined as follows:

$$Q = Q_H + Q_L = f(H, T_{in}, T_{out}, T_G, \Delta t) + g(H, T_{out}, h, T_D) \quad (3)$$

wherein H, $T_{in}$, h and $T_D$ are predetermined values. $Q_H$ and $Q_L$ are calculated by giving an assumed value of the discharge temperature $T_{out}$ to a heating furnace fuel unit consumption calculating function and a rolling line fuel unit consumption calculating function, respectively.

Functions f and g are each a non-linear equation, so the discharge temperature is calculated by a conventional non-linear equation optimizing method so as to satisfy the metallurgical restrictive condition $T_{out}^*$ and obtain a minimum Q.

FIG. 3 shows a relation among $Q_L$, $Q_H$, Q and the restrictive condition $T_{out}^*$ and an optimum discharge temperature.

Figure 5:
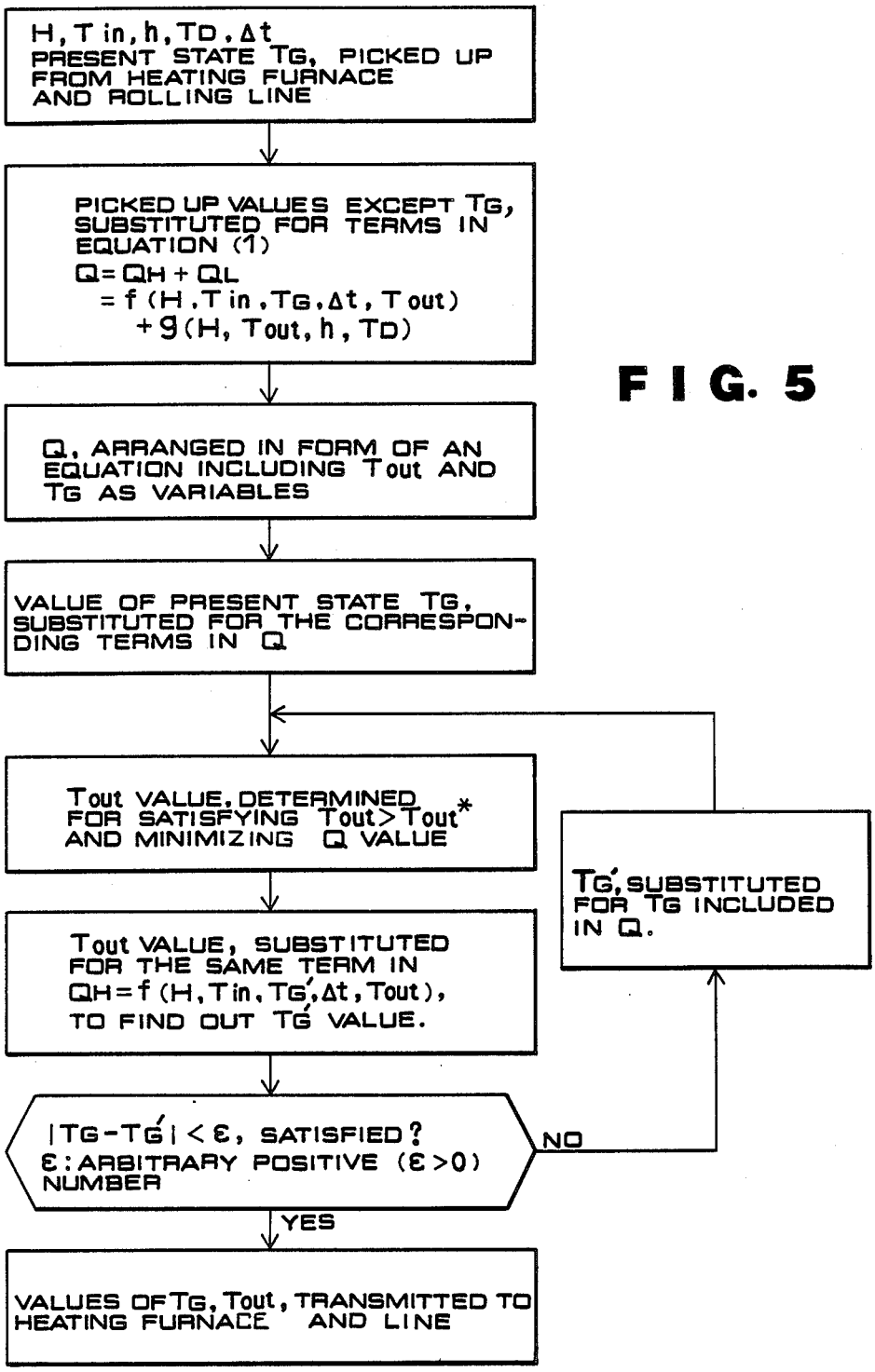
FIG. 5 is a flowchart of the method shown in FIG. 4.

An embodiment of the present invention based on such principle will be described below with reference to FIGS. 4 and 5.

In the figures, the reference numeral 1 denotes an optimum discharge temperature calculating means, numeral 2 denotes a heating furnace fuel unit consumption calculating means for deriving the heating furnace fuel unit consumption $Q_H$ in accordance with the foregoing equation (1), numeral 3 denotes a rolling line fuel unit consumption calculating means for deriving the rolling line fuel unit consumption $Q_L$ in accordance with the foregoing equation (2), numeral 4 denotes a heating furnace combustion controlling means, and numeral 5 denotes a schedule calculating means.

Now the operation of this embodiment will be explained. Upon receipt of an instruction (e.g. rolling line information, plate thickness, finishing discharge side temperature) from a host computer, the optimum discharge temperature calculating means 1 provides a discharge temperature initial value $T_{out}^o$ to the heating furnace fuel unit consumption calculating means 2 and the rolling line fuel unit consumption calculating means 3.

The heating furnace fuel unit consumption calculating means 2 calculates a minimum fuel unit consumption $Q_H$ on the basis of the present heating furnace information (e.g. furnace temperature, fuel flow rate) and provides it to the optimum discharge temperature calculating means 1.

Likewise, upon receipt of the discharge temperature initial value $T_{out}^o$, the rolling line fuel unit consumption calculating means 3 calculates a rolling line fuel unit consumption $Q_L$ on the basis of the present rolling line information and provides it to the optimum discharge temperature calculating means 1. The means 1 repeats the above processing several times and calculates an optimum discharge temperature $T_{out}$ so as to satisfy the metallurgical restrictive condition $T_{out}^*$ and minimize the total fuel unit consumption $Q=Q_H+Q_L$, according to a conventional non-linear equation optimizing processing, and provides it to the heating furnace combustion controlling means 4 and the schedule calculation means 5, whereby the energy saving in the entire line including the heating furnace portion and the rolling portion is realized.

Although the above embodiment has been described with respect to an on-line function using the present heating furnace information and rolling line information, the same effect can be expected also with respect to an off-line function in which calculations are performed in advance by a host computer.

According to the present invention, as set forth hereinbefore, a total fuel unit consumption in the entire line is obtained from a heating furnace fuel unit consumption and a rolling line fuel unit consumption, and an optimum discharge temperature is calculated so as to satisfy a metallurgical discharge temperature restrictive condition and minimize the above total fuel unit consumption, by a non-linear equation optimizing processing, and the thus-calculated optimum discharge temperature is used as a steel stock discharge temperature. Therefore, it is possible to attain energy saving throughout the entire hot rolling line.

What is claimed is:

1. A method for setting a steel stock discharge temperature of a heating furnace in a hot rolling line, comprising the steps of:

(a) determining a fuel unit consumption in the heating furnace by a heating furnace fuel unit consumption calculating means employing the equation $$Q_H = f(H, T_{in}, T_{out}, T_G, \Delta t)$$

where,
H: plate thickness in the heat furnace (mm)
$T_{in}$: charging temperature (° C.)
$T_{out}$: discharge temperature (° C.)
$T_G$: intra-furnace atmosphere temperature (° C.)
$\Delta t$: intra-furnace residence time (hour);

(b) determining a fuel unit consumption in a rolling line by a rolling line fuel unit consumption calculating means employing the equation $$Q_L = g(H, T_{out}, h, T_D)$$

where,
h: final plate thickness (mm)
$T_D$: finishing discharge temperature (° C.)

(c) determining a total fuel unit consumption Q ($Q=Q_H+Q_L$) in the entire line from said fuel unit consumption in the heating furnace and said fuel unit consumption in the rolling line with $T_{out}$ and $T_G$ as variables; and (d) substituting present state $T_G$ as value of $T_G$ in the equation for Q;

(e) determining an optimum discharge temperature so as to satisfy a metallurgical discharge temperature restrictive condition and minimize said total fuel unit consumption, according to a non-linear equation optimizing processing, by an optimum discharge temperature calculating means, said optimum discharge temperature calculating means performing the steps of:

(1) determining $T_{out}$ value for minimizing Q;

(2) substituting $T_{out}$ value so determined in first equation above to determine intra-furnace atmosphere temperature $T_G'$;

(3) determining whether $T_G - T_G' < \epsilon$, where $\epsilon$ is an arbitrary positive number;

(4) if equation in step (3) is not satisfied, substituting $T_G'$ for $T_G$ and repeating steps (1), (2) and (3) until equation in step (3) is satisified and (f) using said optimum discharge temperature as the steel stock discharge temperature.

* * * * *